US007630659B2

(12) United States Patent
Uchitani et al.

(10) Patent No.: US 7,630,659 B2
(45) Date of Patent: Dec. 8, 2009

(54) METHOD AND APPARATUS FOR IMAGE FORMING CAPABLE OF EFFECTIVELY PERFORMING A CHARGING PROCESS

(75) Inventors: Takeshi Uchitani, Kamakura (JP); Eisaku Murakami, Tokyo-to (JP); Yoshiyuki Kimura, Tokyo-to (JP); Masahiko Satoh, Machida (JP); Masanori Kawasumi, Yokohama (JP); Hideki Zemba, Kawasaki (JP); Eiji Shimojo, Tokyo-to (JP); Shunichi Hashimoto, Yokohama (JP); Shin Kayahara, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 449 days.

(21) Appl. No.: 11/430,068

(22) Filed: May 9, 2006

(65) Prior Publication Data

US 2006/0251438 A1 Nov. 9, 2006

(30) Foreign Application Priority Data

May 9, 2005 (JP) ..... 2005-136102
Sep. 9, 2005 (JP) ..... 2005-263019

(51) Int. Cl.
*G03G 15/02* (2006.01)
*G03G 15/00* (2006.01)

(52) U.S. Cl. ..... 399/50; 399/44

(58) Field of Classification Search ..... 399/50, 399/174–176, 21, 31, 44; 361/225
See application file for complete search history.

(56) References Cited

U.S. PATENT DOCUMENTS 5,749,022 A * 5/1998 Kikui et al. ..... 399/50
6,360,065 B1 3/2002 Ishibashi et al.
6,615,002 B2 * 9/2003 Saito et al. ..... 399/43
6,807,390 B2 10/2004 Suda et al.
6,829,444 B2 * 12/2004 Ashikawa ..... 399/44
6,882,806 B2 * 4/2005 Sunahara et al. ..... 399/50
6,970,661 B2 * 11/2005 Shoji ..... 399/50
7,035,560 B2 * 4/2006 Okano et al. ..... 399/50
7,116,922 B2 * 10/2006 Takahashi et al. ..... 399/50
7,162,173 B2 * 1/2007 Motohashi et al. ..... 399/50
2005/0271420 A1 12/2005 Arai et al.

FOREIGN PATENT DOCUMENTS

JP 2001-109238 4/2001
JP 2002-108059 4/2002
JP 2004258540 A * 9/2004

* cited by examiner

*Primary Examiner*—Robert Beatty
(74) *Attorney, Agent, or Firm*—Oblon, Spivak, McClelland, Maier & Neustadt, L.L.P.

(57) ABSTRACT

A method and an apparatus of controlling a charge voltage including the steps of applying, charging, detecting, and determining. The applying step applies an application voltage having a direct-current voltage and an alternating-current voltage superimposed onto the direct-current voltage to a charge-applying member to charge a charge carrier. The changing step charges the alternating-current voltage of the application voltage. The detecting step detects an alternating current flowing through the charge carrier when the charge-applying member applies the application voltage to the charge carrier. The determining step determines a value of the alternating-current voltage of the application voltage based on at least two alternating currents detected by the alternating-current detector.

15 Claims, 10 Drawing Sheets

METHOD AND APPARATUS FOR IMAGE FORMING CAPABLE OF EFFECTIVELY PERFORMING A CHARGING PROCESS

BACKGROUND OF THE INVENTION

1. Field of the Invention

The present invention relates to a method and apparatus for image forming, and more particularly to a method and apparatus for image forming capable of effectively performing a charging process with a charging power of a direct current voltage superimposed by an alternating current voltage.

2. Discussion of the Background

A background image forming apparatus employing an electrophotographic process includes a charging device constituting a charging mechanism configured to charge a photoconductor surface serving as an image carrier. One example charging device uses a proximity discharge method. In this charging device, a charging roller constituting a charging member is arranged to have a surface facing in close proximity to the photoconductor surface so as to form a discharge area with a minimum gap therebetween. The charging roller may be arranged in contact with the photoconductor surface. In this case, a discharge area is formed around a minute gap in vicinity to a contact part between the charging roller and the photoconductor surface.

In the charging device, obtaining a discharge amount capable of uniformly charging the photoconductor is known on an experimental basis and includes applying to the charging roller a direct current voltage and an additional alternating current voltage (i.e., a peak-to-peak voltage). The additional alternating current voltage is double a voltage Vth of the direct current voltage with which the charging roller starts a discharge to the photoconductor.

However, this known technique is suboptimal because the direct current voltage Vth may fluctuate due to variations in a resistance of the charging roller or a size of the gap caused by swelling of the charging roller due to an environment change. For example, Table 1 indicates a relationship between the direct current voltage Vth and an absolute humidity (AH) in units of $g/cm^3$.

As a result of these fluctuations, the alternating current voltage (i.e., the peak-to-peak voltage) applied to the charging roller may drop below the value double the voltage Vth, and thereby the discharge to the photoconductor may not be performed, or the photoconductor may not be uniformly charged.

On the other hand, in a case where the alternating current voltage with more than a necessary amount is applied to the charging roller, an amount of the discharge to the photoconductor becomes excessive. This excessive voltage may deteriorate and whittle the photoconductor surface. As a result, a satisfactory image may not be maintained.

TABLE 1

| | AH | | | | |
|---|---|---|---|---|---|
| | 0 ≦ AH < 5 | 5 ≦ AH < 8 | 8 ≦ AH < 18 | 18 ≦ AH < 26 | 26 ≦ AH |
| Vth (volts) | 2050 | 1840 | 1700 | 1670 | 1640 |

Another example charging device includes an environment detection mechanism configured to detect temperature and/or humidity and attempts to adjust the alternating current voltage applying to the charging roller based on a result detected by the environment detection mechanism. However, this charging device requires an additional memory mechanism to be able to store the alternating current voltage corresponded to each environment such as temperature and humidity.

On the other hand, it has been known that the photoconductor surface is uniformly charged to a predetermined potential without being affected by the gap change when the alternating current value flowing to the photoconductor is equal to or above a predetermined value Ivth at a start of the discharge to the photoconductor. This predetermined value Ivth may be sought on an experimental basis and can be provided to the above-described example charging device as a reference. Thereby, the charging device can control the alternating current voltage value applying to the charging roller to equalize it with the predetermined value Ivth.

In particular, a predetermined alternating current voltage is applied to the charging roller during a warm-up time before an image forming operation is started, and a value of the alternating current is then detected. The alternating current value is determined whether or not equal to or above the predetermined value Ivth. In a case where the alternating current value is below the predetermined value Ivth, the alternating current voltage value is increased. After that, the alternating current value is again detected. Such operation is repetitively performed so that the alternating current voltage value capable of obtaining the reference alternating current value is set.

SUMMARY OF THE INVENTION

The invention includes a method of controlling a charge voltage including the steps of applying, charging, detecting, and determining. The applying step applies an application voltage (the application voltage having a direct-current voltage and an alternating-current voltage superimposed onto the direct-current voltage) to a charge-applying member so as to charge a charge carrier. The changing step charges the alternating-current voltage of the application voltage. The detecting step detects an alternating current flowing through the charge carrier when the charge-applying member applies the application voltage to the charge carrier. The determining step determines a value of the alternating-current voltage of the application voltage based on at least two alternating currents detected by the alternating-current detector.

The invention also includes an image forming apparatus including a charge carrier configured to carry a charge and a charging device configured to charge a surface of the charge carrier. The charging device includes a charge-applying member arranged at a position in parallel and facing the charge carrier, and a power controller configured to apply to the charge carrier an application voltage including a direct-current voltage and an alternating-current voltage superimposed onto the direct-current voltage. The charging device further includes an alternating-current detector configured to detect an alternating current flowing through the charge carrier when the charge-applying member applies the application voltage to the charge carrier, and a voltage value controller configured to determine a value of the alternating-current voltage of the application voltage based on at least two alternating currents detected by the alternating-current detector.

The invention also includes a charging device including a charge carrier configured to carry a charge and a charging device configured to charge a surface of the charge carrier. The charging device includes a charge-applying member arranged at a position in parallel and facing the charge carrier, and a power controller configured to apply to the charge carrier an application voltage including a direct-current voltage and an alternating-current voltage superimposed onto the direct-current voltage. The charging device further includes an alternating-current detector configured to detect an alternating current flowing through the charge carrier when the charge-applying member applies the application voltage to the charge carrier, and a voltage value controller configured to determine an alternating-current voltage value of the application voltage based on at least two alternating currents detected by the alternating-current detector.

The invention also includes a process cartridge exchangeably installed in an image forming apparatus. The process cartridge including a charge carrier configured to carry a charge and a charging device configured to charge a surface of the charge carrier. The charging device includes a charge-applying member arranged at a position in parallel and facing the charge carrier, and a power controller configured to apply to the charge carrier an application voltage including a direct-current voltage and an alternating-current voltage superimposed onto the direct-current voltage. The charging device further includes an alternating-current detector configured to detect an alternating current flowing through the charge carrier when the charge-applying member applies the application voltage to the charge carrier, and a voltage value controller configured to determine an alternating-current voltage value of the application voltage based on at least two alternating currents detected by the alternating-current detector.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
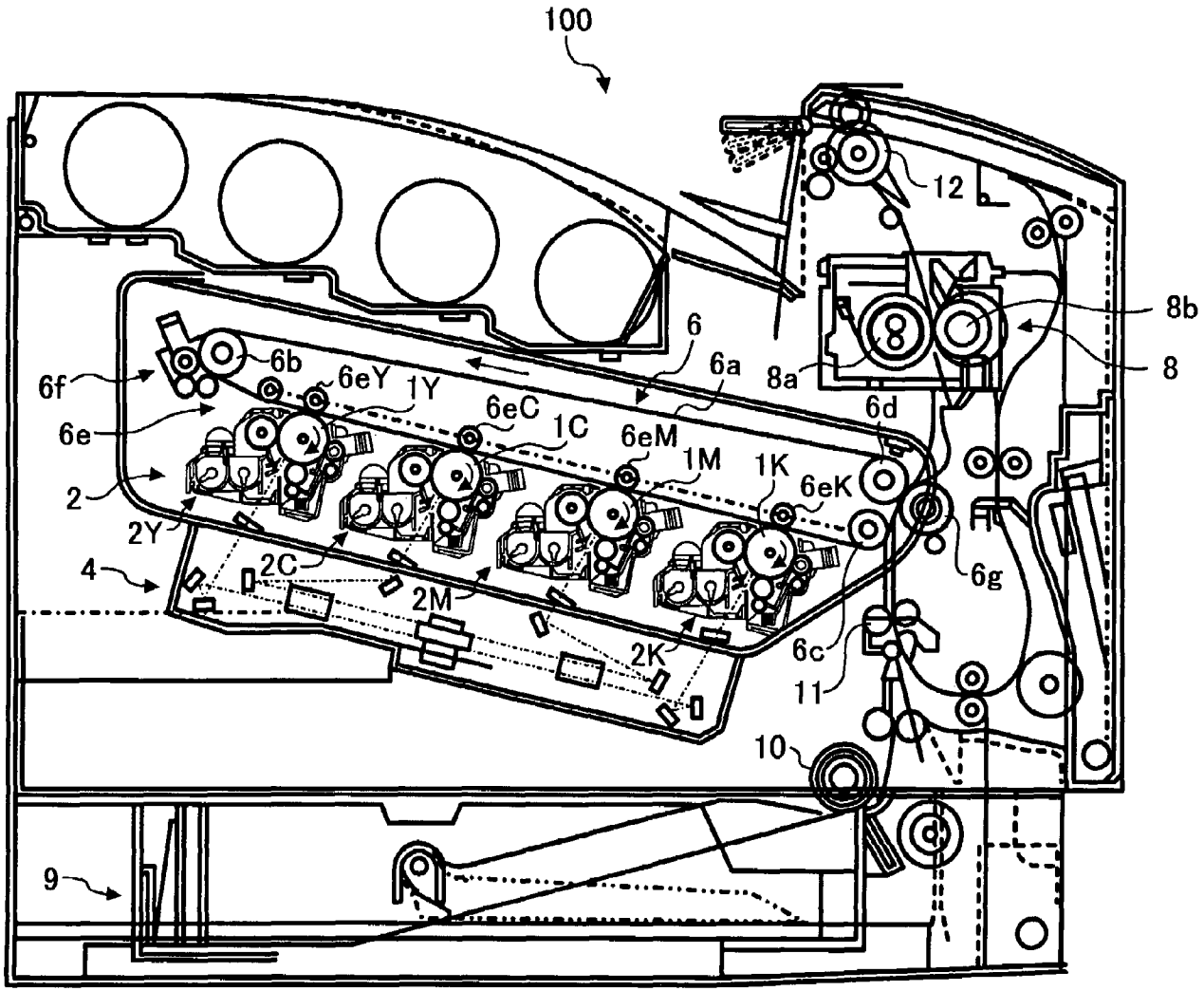
FIG. 1 is a schematic diagram illustrating a printer according to a preferred embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a color laser printer (hereafter simply called a printer) 100 is described. This printer 100 of FIG. 1 exemplarily embodies an image forming apparatus according to the present invention.

Figure 2:
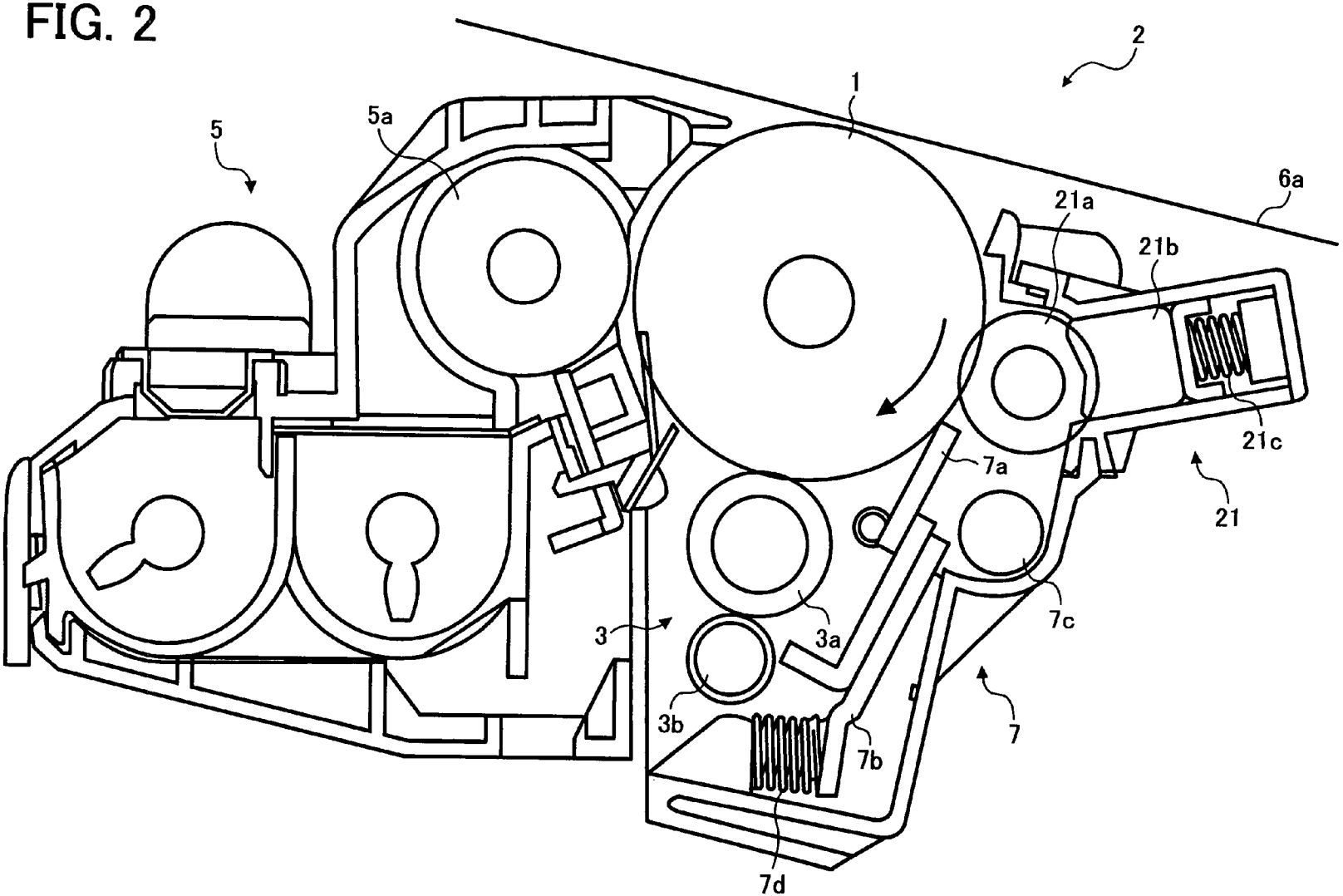
FIG. 2 is a schematic diagram illustrating an image forming unit including a charging device of the printer illustrated in FIG. 1.

As illustrated in FIG. 1, the printer 100 includes four photoconductors 1Y, 1C, 1M, and 1K (where Y, C, M, and K refer to yellow, cyan, magenta, and black, respectively) as latent image carriers, an image forming unit 2 constituting a process cartridge described in FIG. 2, an exposure device 4, a transfer device 6, a heat fixing device 8, a paper feed cassette 9, a pickup roller 10, a resist roller pair 11, and a paper ejection roller 12. The transfer device 6 includes an intermediate transfer belt 6*a*, three support rollers 6*b*, 6*c*, and 6*d*, a primary transfer roller 6*e*, and a secondary transfer roller 6*g*. The intermediate transfer belt 6*a* includes a belt cleaning device 6*f* in the vicinity thereof. The primary transfer roller 6*e* includes primary transfer rollers 6*e*Y, 6*e*C, 6*e*M, and 6*e*K. The heat fixing device 8 includes a heat roller 8 a and a pressure roller 8*b*.

Each of the photoconductors 1Y, 1C, 1M, and 1K is rotationally driven in a direction indicated by an arrow in FIG. 1 while being contacted to the intermediate transfer belt 6*a* forming a surface movement member. The intermediate transfer belt 6*a* in the transfer device 6 is laid across the support rollers 6*b*, 6*c*, and 6*d*, and performs an endless movement in the arrow direction. The intermediate transfer belt 6*a* onto which toner images formed on the photoconductors 1Y, 1C, 1M, and 1K are sequentially transferred by an electrostatic transfer system such that the toner images are overlaid one another into a full-color toner image. The electrostatic transfer system may include a configuration employing a transfer charger, however, the transfer roller 6*e* unlikely generating transfer dust is employed, as illustrated in FIG. 1. In particular, the primary transfer rollers 6*e*Y, 6*e*C, 6*e*M, and 6*e*K are disposed at an inner surface of the intermediate transfer belt 6*a* while the photoconductors 1Y, 1C, 1M, and 1K are disposed in contact with an outer surface of the intermediate transfer belt 6*a*. Here, a primary transfer area is formed by a part of the intermediate transfer belt 6*a* pressed by the primary transfer roller 6*e* and the photoconductor 1. Then, a bias of a positive polarity is applied to the primary transfer roller 6*e* when the toner images on the photoconductors 1Y, 1C, 1M, and 1K are transferred onto the intermediate transfer belt 6*a*. Thereby, a transfer electric field is formed in an area in which each primary transfer is performed (hereafter called a transfer area) so that the toner images on the photoconductors 1Y, 1C, 1M, and 1K are electrostatically attracted and transferred onto the intermediate transfer belt 6*a*.

In the vicinity of the intermediate transfer belt 6*a*, the belt cleaning device 6*f* is disposed so that remaining toner is removed from a surface of the intermediate transfer belt 6*a*. The belt cleaning device 6*f* is designed to collect unnecessary toner adhered to the surface of the intermediate transfer belt 6*a* by a fur brush and a cleaning blade. The collected unnecessary toner is conveyed to a waste toner tank (not shown) from inside the belt cleaning device 6*f* by a conveyance mechanism (not shown). Further, the secondary transfer roller 6*g* is contacted and disposed in a part of the intermediate transfer belt 6*a* laid across the support roller 6*d*. A secondary transfer area including a secondary transfer nip part is formed between the intermediate transfer belt 6*a* and the secondary transfer roller 6*g*, and a transfer sheet as a recording member is fed into the area at a predetermined timing. The transfer sheet is accommodated inside the paper feed cassette 9 installed below the exposure device 4 of FIG. 1, and is conveyed to the secondary transfer area by an instrument such as the pickup roller 10 and the resist roller pair. Then, the toner images overlaid on the intermediate transfer belt 6*a* are simultaneously transferred onto the transfer sheet in the secondary transfer area. During the secondary transfer, the bias of the positive polarity is applied to the secondary transfer roller 6*g* so that the transfer electric field is formed, and the toner images on the intermediate transfer belt 6*a* are transferred onto the transfer sheet.

The heat fixing device 8 as a fixing mechanism configured to fix the toner image is disposed in a downstream side of a transfer sheet conveyance direction of the secondary transfer area with the heat roller 8*a* in which a heater is embedded and the pressure roller 8*b* which applies pressure. The transfer sheet passed the secondary transfer nip part is inserted between the heat roller 8*a* and the pressure roller 8*b*, and receives heat and pressure. Thereby, the toner on the transfer sheet is fused so that the toner image is fixed on the transfer sheet. Then, the transfer sheet with fixed image is ejected on a sheet ejection tray in an upper surface of the printer by the paper ejection roller 12.

Further, the printer 100 of the embodiment executes a process control operation as an image density adjustment mechanism configured to adjust an image density such that the image density of each color is optimized when a power source is activated or after a predetermined number of sheets are passed.

In the process control operation, a density detection patch as a plurality of graduation patterns of each color is formed on the intermediate transfer belt 6*a* by sequentially switching a charging bias and a development bias at an appropriate timing. Output voltage of the patterns is detected by a density detection sensor as an optical detection device disposed outside the intermediate transfer belt 6*a* in the vicinity of the support roller 6*c*. The output voltage is performed an adhesion quantity exchange by an adhesion quantity exchange algorithm (e.g., a powder adhesion quantity exchange system), and calculates a current development ability (development γ, Vk) so that change of a current bias value and a toner density control target value are controlled based on a calculated value of the current development ability.

Referring to FIG. 2, the image forming unit 2 shown in FIG. 1 includes the photoconductor 1, a development device 5, an application device 21, a cleaning device 7, and a charging device 3. The development device 5 includes a development roller 5*a* which includes a magnet roller and a development sleeve (not shown). The application device 21 includes a brush type roller 21*a*, a lubricant mold body 21*b*, and a pressure spring 21*c*. The cleaning device 7 includes a cleaning blade 7*a*, a support member 7*b*, a toner collection coil 7*c*, and a blade pressure spring 7*d*. The charging device 3 includes a charging roller 3*a* and a charging cleaning member 3*b*. The image forming unit 2 is treated as image forming units 2Y, 2C, 2M, and 2K in FIG. 1. The image forming units 2Y, 2C, 2M, and 2K are detachable from the printer 100, and may be replaced at one time. The photoconductor 1 is treated as photoconductors 1Y, 1C, 1M, and 1K in FIG. 1. The image forming units 2Y, 2C, 2M, and 2K have respective photoconductors 1Y, 1C, 1M, and 1K. As a configuration of each photoconductor in the image forming unit is identical, codes Y, M, C, and B are omitted in following drawings.

In the vicinity of the photoconductor 1, the development device 5 which forms the toner image from the latent image, the application device 21 which applies a lubricant to the photoconductor 1, the cleaning device 7 which cleans remaining toner on the photoconductor 1, and the charging device 3 which charges the photoconductor 1 are disposed in sequence.

In the development device 5, the development roller 5*a* is partially exposed from an opening. Here, a two-component developer consisting of a toner and a carrier is preferably used, however, a one-component developer without the carrier may be used. The development device 5 receives a corresponding color of toner supplied from a toner bottle (not shown). The magnet roller acts as a magnetic field generator, and the development sleeve performs a coaxial rotation around the magnetic roller. The carrier in the developer moves into a chain shape by a magnetic force generated by the magnetic roller, and is conveyed to a development area which is opposed to the photoconductor 1. In the area opposing to the photoconductor 1 (hereafter called a development area), the development roller 5*a* performs a surface migration at linear velocity which is faster than that of the photoconductor 1 in the same direction. The carrier on the development roller 5*a* in the chain shape supplies the toner adhered on a carrier surface to a surface of the photoconductor 1 so that development is performed while scraping the surface of the photoconductor 1. At this time, the development bias is applied to the development roller 5*a* from the power source (not shown) so that a development electric field is formed in the development area.

In application device 21, brush type roller 21*a* whittles the lubricant by contacting the lubricant mold body 21*b* so as to apply the lubricant to the photoconductor 1, the lubricant mold body 21*b* is accommodated in a fixed case, and the pressure spring 21*c* presses the lubricant mold body 21*b* against the brush type roller 21*a*. The lubricant mold body 21*b* is formed in a rectangular parallelepiped shape, and the brush type roller 21*b* is formed in a shape extended in an axial direction of the photoconductor 1. The lubricant mold body 21*b* is energized at the pressure spring 21*c* with respect to the brush type roller 21*a* so as to be almost completely consumed. As the lubricant mold body 21*b* is a consumable item, thickness thereof may be economically reduced. Lubricant mold body 21*b* is pressed by the pressure spring 21*c* so as to be constantly abutted against the brush type roller 21*a*. Also, the lubricant device 21 may be disposed inside the cleaning device 7 with the cleaning blade 7*a* (used to clean the remaining toner). Thereby, the toner adhered to the brush by scraping the photoconductor 1 with the brush type roller 21*a* is shaken off by the lubricant mold body 21*b* or a flicker (not shown), and is easily collected.

For the lubricant, for example, a fatty acid metallic salt, a silicone oil, and a fluoric resin may be used solely or in combination. For the fatty acid metallic salt, for example, a zinc stearate, a magnesium stearate, an aluminum stearate, and an iron stearate are preferred, and the zinc stearate is the most preferred. Further, for example, a powder body of the zinc stearate and a calcium stearate may be used as the lubricant, or a mold body on which a fluorine particle is heavily applied may be used as the lubricant mold body.

In the cleaning device 7, the cleaning blade 7*a* removes the remaining toner on the photoconductor after the transfer. For the cleaning blade 7*a*, a thermosetting urethane resin is preferred, and a urethane elastomer is particularly preferred from resistance standpoints of an abrasiveness, an ozone-proof, and a contamination. The elastomer may include rubber.

In the charging device 3, the charging roller 3*a* as a charging member is disposed opposing to the photoconductor 1, and the charging cleaning member 3*b* is disposed so as to abut against a surface which is an opposite side of the surface opposing to the photoconductor 1.

Figure 3:
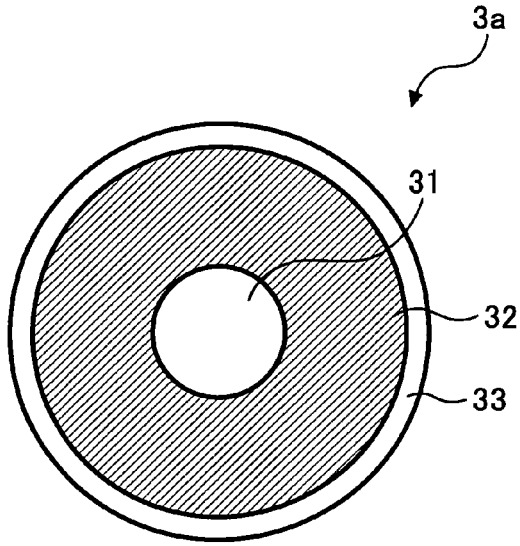
FIG. 3 is an illustration of a charging roller in a cross sectional view, included in the image forming unit of FIG. 2.

Referring to FIG. 3, the charging roller 3 a shown in FIG. 2 includes a core metal 31, a resistance adjustment layer 32, and a protection layer 33. The core metal 31 is a conductive support body and has a circular shape. The resistance adjustment layer 32 is formed with uniform thickness on an outer circumference surface of the core metal 31. The protection layer 33 prevents leakage by coating a surface of the resistance adjustment layer 32.

Figure 4:
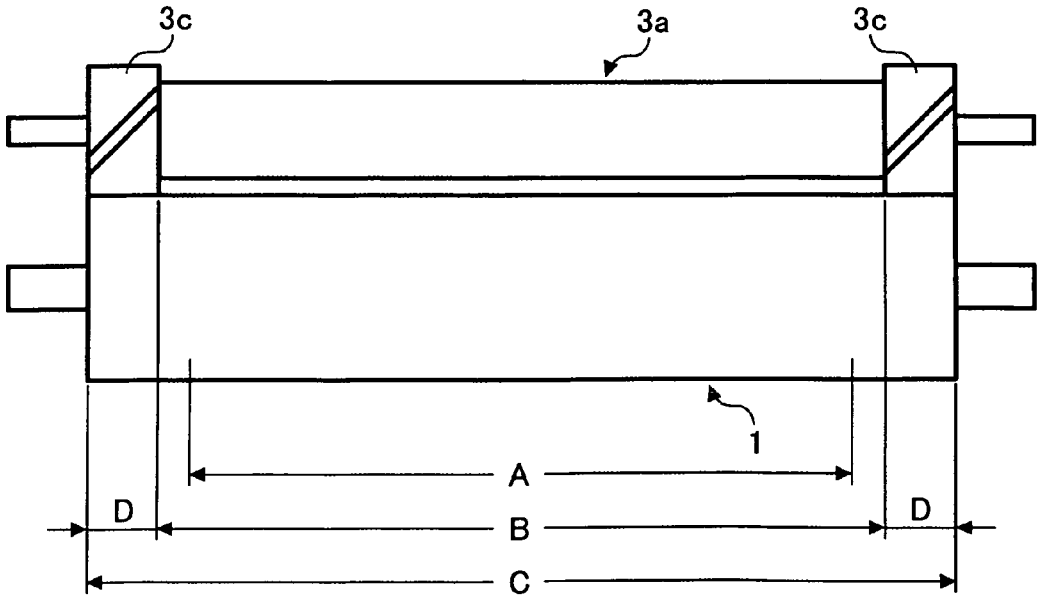
FIG. 4 is an illustration of the charging roller and a photoconductor included in the image forming unit of FIG. 2.

FIG. 4 illustrates the charging roller 3*a* and the photoconductor 1. FIG. 4 includes an image forming area A in which the toner image is formed, a charging area B which is charged by the charging member, a photoconductor width C (e.g., image carrier width) which is a length of the photoconductor, a non-image forming area D in which toner is not formed, the charging roller 3*a*, the photoconductor 1, and a void holding member 3C. The void holding member 3*c* is nonconductive, and is placed in correspondence to the non-image forming area D of the photoconductor 1 in both ends of an axial direction of the charging roller 3*a*. The void holding member 3*c* contacts the non-image forming area D of the photoconductor 1, and the charging roller 3 rotates with a movement of the photoconductor 1. Also, a predetermined gap between the image forming area A of the photoconductor 1 and the charging roller 3*a* is maintained in a non-contact state by the void holding member 3*c*.

Figure 5:
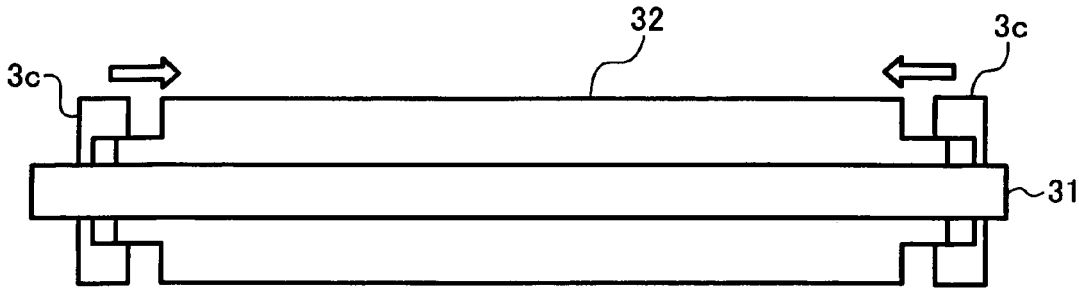
FIG. 5 is an illustration of a void holding member being inserted to a resistance adjustment layer of the charging roller.
Figure 6:
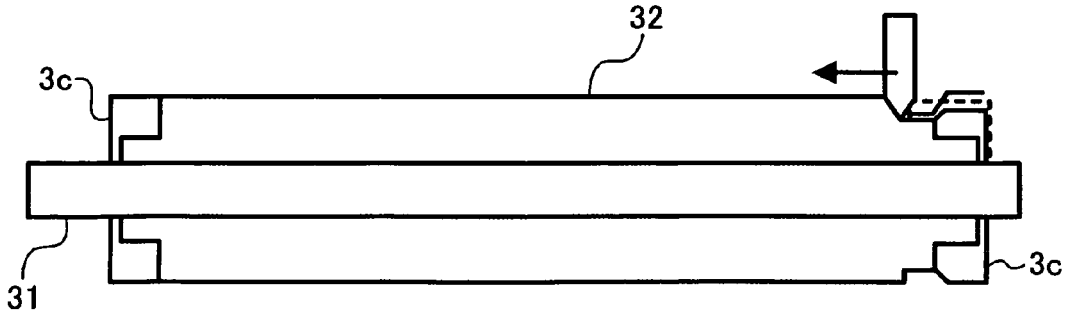
FIG. 6 is an illustration of the resistance adjustment layer of the charging roller and the void holding member being under cutting work.

Referring to FIG. 5 and FIG. 6, a forming process of the charging roller 3*a* is illustrated with the resistance adjustment layer 32, the void holding member 3*c*, and the core metal 31. First, the void holding member 3*c* is inserted to a step part formed at both ends of an axial direction of the resistance adjustment layer 32 as shown in FIG. 5. Then, a removal process such as cutting is performed on the void holding member 3*c* and the resistance adjustment layer 32 so that difference of elevation is formed between the void holding member 3*c* and the resistance adjustment layer 32. Variation in difference of the elevation between the void holding member 3*c* and the resistance adjustment layer 32 may be at least 10 μm, for example, by forming the charging roller 3*a*. Then, a finishing process such as dipping is performed, and the protection layer 33 is formed (see FIG. 3).

The charging roller 3*a* is connected to the power source, and a predetermined voltage is applied so that an alternating-current (AC) voltage is superimposed on an direct-current (DC) voltage. A predetermined amount of the AC current flows to the surface of the photoconductor 1 by applying the AC voltage (i.e., peak-to-peak voltage Vpp) so that a charging potential of the photoconductor surface achieves a predetermined value.

Figure 7:
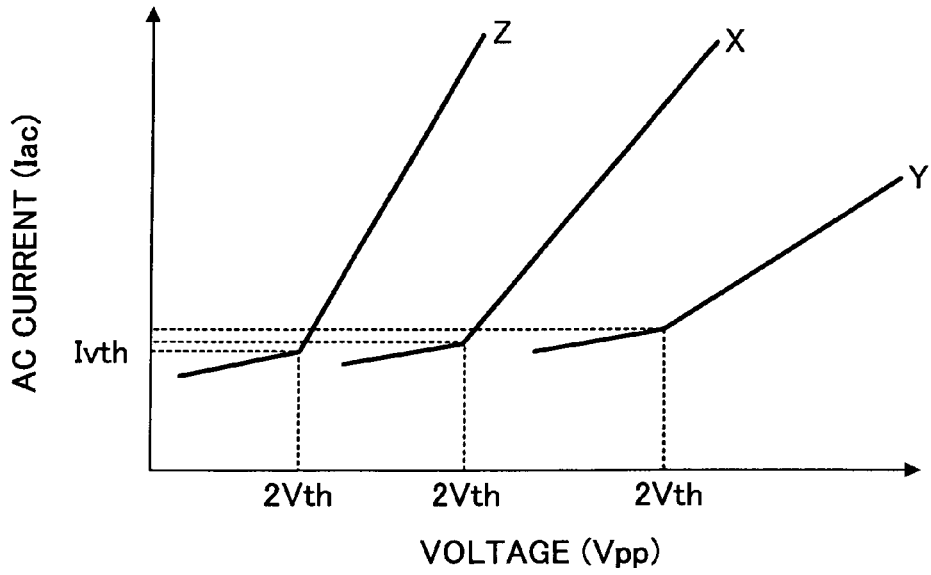
FIG. 7 is a graph for explaining an example relationship between an AC current flowing to the photoconductor and an AC voltage (i.e., a peak-to-peak voltage) applying to the charging roller when a gap between the photoconductor and the charging roller is fluctuated.

Referring to a graph of FIG. 7, an example relationship between the AC current flowing to the photoconductor 1 and the AC voltage (i.e., the peak-to-peak voltage) applying to the charging roller 3*a* is explained in a case where the gap is fluctuated for the charging roller 3*a*. In the graph, line X indicates a relationship between the AC current and the AC voltage in a case where the gap between the photoconductor 1 and the charger roller 3*a* is a reference value G. Line Y indicates a relationship between the AC current and the AC voltage in a case where the gap between the photoconductor 1 and the charging roller 3*a* is larger than the reference value G. Line Z indicates a relationship between the AC current and the AC voltage in a case where the gap between the photoconductor 1 and the charging roller 3*a* is smaller than the reference value G.

As shown in FIG. 7, the inclination of lines indicating the relationship between the AC current and the AC voltage varies at a turning point where the AC voltage value is double a value Vth of a direct-current voltage. This Vth is a discharge-start voltage which is generated when the alternating-voltage is applied to a charging mechanism configured to charge a body to be charged. The inclination of the lines may be small when the AC voltage value is below the value double the voltage Vth because an increase of the AC-current value flowing to the photoconductor is relatively small with respect to an increase of the AC voltage by action of the charging roller 3*a* and the photoconductor 1 as a capacitor. On the other hand, inclination of the lines may be large when the AC voltage value is at least the value double the voltage Vth because the AC-current value flowing to the photoconductor is increased by discharge generated between the charging roller 3*a* and the photoconductor 1.

As shown in FIG. 7, the value double the voltage Vth fluctuates significantly with variations in the size of the gap. On the other hand, the AC-current Ivth flowing to the photoconductor 1 does not fluctuate significantly with variations in the size of the gap when the Vth is double. Thus, a significant difference between a) the AC-current Ivth where the gap between the photoconductor 1 and the charging roller 3*a* is largest and b) the AC-current Ivth where the gap between photoconductor 1 and the charging roller 3*a* is smallest does not occur. Therefore, the surface of the photoconductor 1 may be uniformly charged without reaching a discharge level which deteriorates the photoconductor even if the AC voltage of the power source is set such that the AC-current Ivth at which the gap between the photoconductor 1 and the charging roller 3*a* is the largest is obtained (corresponding to the case where the gap between the photoconductor 1 and the charger roller 3*a* is the smallest).

In this embodiment, an AC voltage value (hereafter called a reference voltage value Vpp_aim) is applied to the charging roller 3*a* such that AC-current value flowing to the photoconductor 1 is a predetermined current value (hereafter called a reference AC-current A). Accordingly, a voltage setting mechanism configured to set the determined AC-voltage value as a reference voltage value is formed. The reference voltage value (i.e., a peak-to-peak voltage) set by the voltage setting mechanism is applied to the charging roller 3*a* by superimposing on the DC voltage. The reference AC-current A is set at the AC-current Ivth at which the gap between the photoconductor 1 and the charging roller 3*a* is the largest, or slightly higher.

A determination of the reference-voltage value Vpp_aim is explained next. As shown in FIG. 7, according to the relationship between the AC voltage with the value at least double the voltage Vth and the AC current, the inclination varies depending on each gap. In a case where the gap between the photoconductor 1 and the charging roller 3*a* is large, a resistant value of the gap becomes higher than when the gap is small, so that the inclination becomes smaller than when the gap between the photoconductor 1 and the charging roller 3*a* is small. Further, the inclination may be changed by changing the resistance value of the charging roller 3*a* caused by various situations such as an environment change, adhesion of a foreign substance to the charging roller 3*a*, and deterioration of the charging roller 3*a*. In this embodiment, a relational expression between the AC voltage at which the value of the charging roller surface becomes at least the value double the voltage Vth and the AC current is determined when the AV voltage is applied to the charging roller. The reference AC-current A is then substituted into the relational expression, thereby determining the reference voltage value Vpp_aim.

Figure 8:
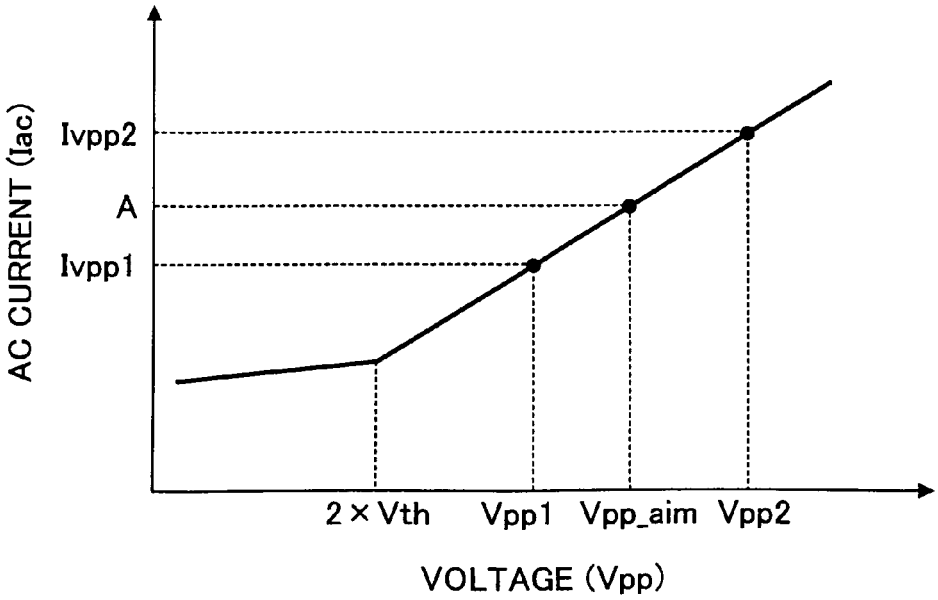
FIG. 8 is a graph for explaining a determination of a reference voltage value Vpp_aim.

FIG. 8 is a graph illustrating determination of the reference voltage value Vpp_aim. First, an AC current (i.e., a first detection current Ivpp1) that flows into the photoconductor 1 is detected while a first detection voltage (i.e., first alternating current voltage Vpp1) is applied to the charging roller 3*e*. Next, an AC current (i.e., a second detection current Ivpp2) that flows to the photoconductor is detected while second detection voltage (i.e., second alternating current voltage Vpp2) is applied to the charger roller 3*a*. Then, a first expression is prepared by substitution of the first detection current Ivpp1 and the first detection voltage Vpp1 into the relational expression between the AC voltage with the value at least double the voltage Vth (i.e., the peak-to-peak voltage) and the AC current ((Iac)=a(Vpp)+b). Then a second expression is also prepared by substitution of the second detection current Ivpp2 and the second detection voltage Vpp2 into the relational expression. Simultaneous equations consisted of the first and second expressions are solved for a gradient "a" and intercept "b" in the relational expression, and thereby solving for the relational expression between the AC voltage with the value at least double the voltage Vth and the AC current. Therefore, the reference voltage value Vpp_aim is determined by substitution of the reference current value A into the solved relational expression.

Figure 9:
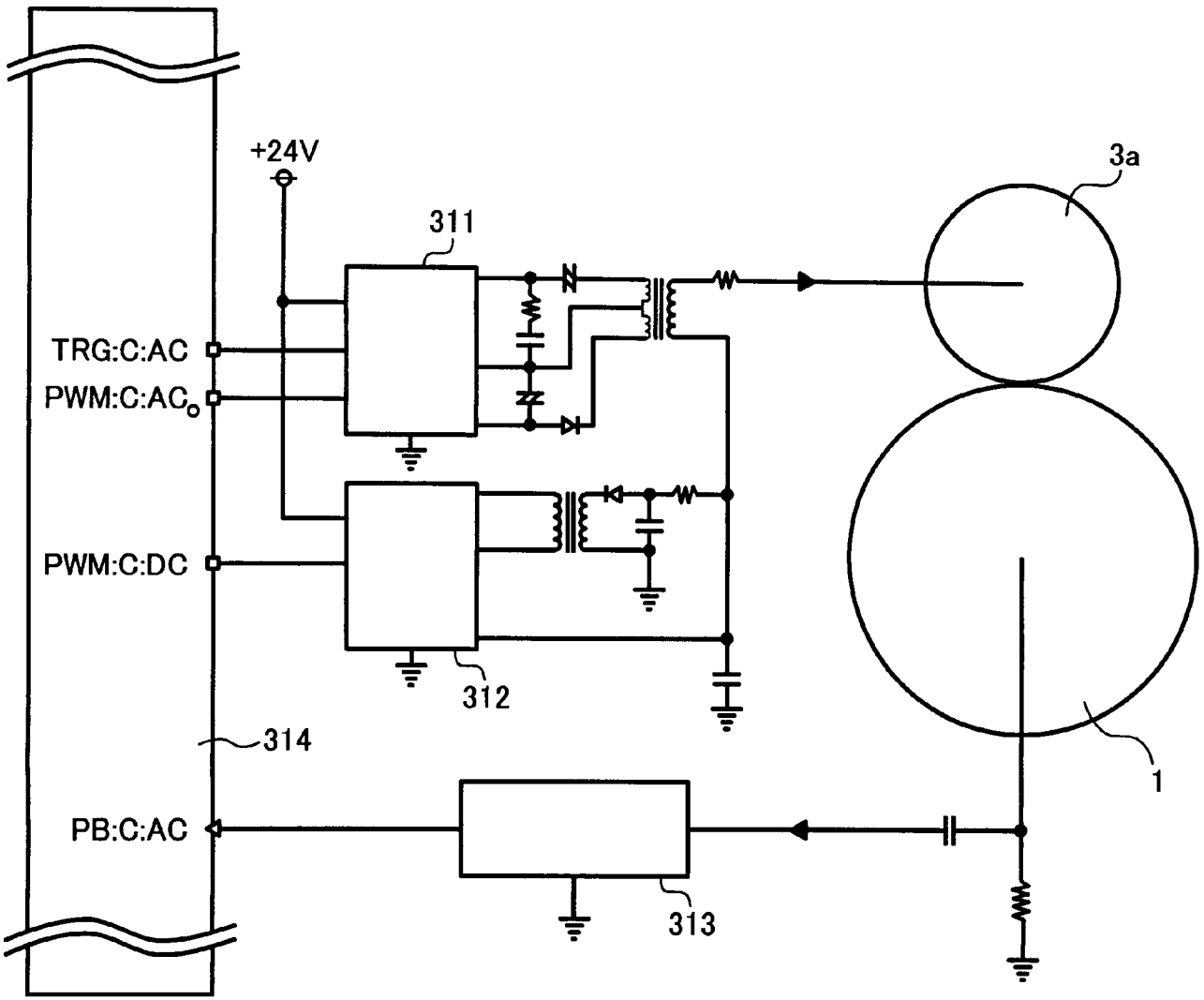
FIG. 9 is an illustration of a power supply circuit and an AC current detection mechanism for the charging device.

FIG. 9 illustrates a power supply circuit (explained below) of the charging device 3 and an AC current detection mechanism configured to detect current flown to the power supply circuit of the charging device 3 and the photoconductor 1. The power supply circuit includes an AC output circuit 311 and a DC output circuit 312, and obtains a stable discharge voltage with two voltage presser mechanisms. One voltage presser mechanism may be employed, but two voltage presser mechanisms may preferably be employed with consideration of output stability.

When a voltage obtained by superimposing the AC voltage on the DC voltage is applied to the charging roller 3*a*, the AC current flows into an AC current feedback circuit (not shown) through the charging roller 3*a* and the photoconductor 1. AC current detection mechanism 313 configured to only detect the AC current is disposed to a ground side of the photoconductor 1. The AC current detected by the AC current detection mechanism 313 is input to a control substrate 314. From a maintenance standpoint, the AC current detection mechanism 313 is disposed to a same substrate on which the power supply circuit of the charging device 3 is disposed in the embodiment. However, the AC current detection mechanism 313 may be mounted on the control substrate 314.

Figure 10:
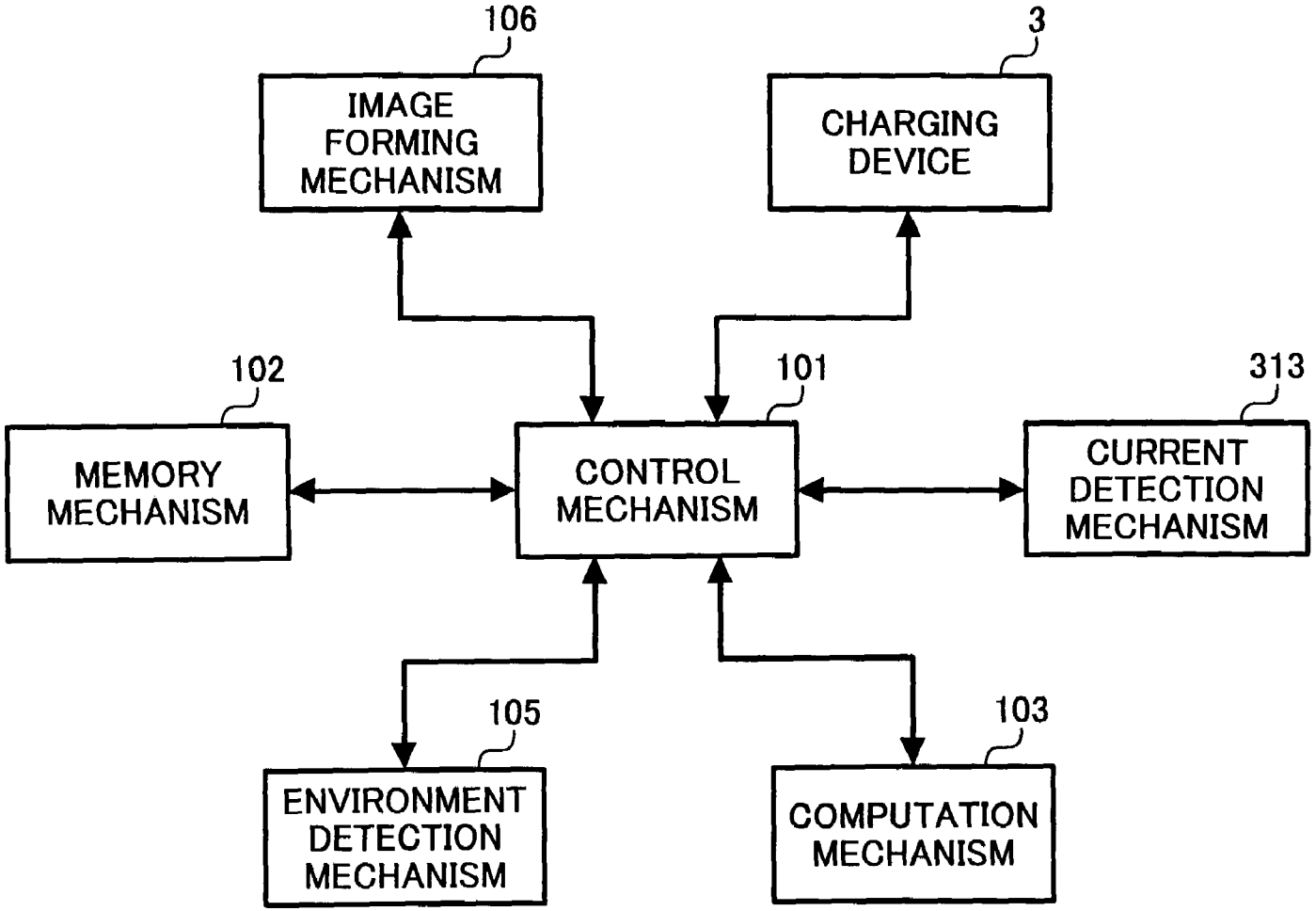
FIG. 10 is a block diagram of an example control system for controlling the AC voltage setting.

FIG. 10 illustrates the voltage setting mechanism which includes a control mechanism 101, a memory mechanism 102, a computation mechanism 103 (which may also refer to an AC voltage calculator), the current detection mechanism 313, the charging device 3, and an image forming mechanism 106. The voltage setting mechanism may include an environment detection mechanism 105 which detects temperature and humidity. The memory mechanism 102 stores a detection voltage (i.e., vpp) and the reference current value A beforehand. The memory mechanism 102 also stores, for example, the detection current (i.e., Ivpp) detected by the current detection mechanism 313, or the reference voltage value Vpp_aim solved by the computation mechanism 103. The computation mechanism 103 includes a function which the relational expression between the AC voltage with the value at least double the voltage Vth and the AC current is computed and derived from the detection current (Ivpp) and the detection voltage (vpp). The computation mechanism 103 further includes a function which the reference voltage value Vpp_aim is computed and derived from the derived relational expression and the reference voltage value A. The control mechanism 101 includes a function which controls a voltage value applying to the charging roller 3*a* of the charging device 3. The control mechanism 101 further includes a function which controls a number of rotations of the photoconductor 1 in the image forming mechanism 106. The image forming mechanism 106 includes the image forming units 2Y, 2M, 2C, and 2K shown in FIG. 1, for example.

The setting of the AC voltage is performed, for example, before the process control operation stated above is executed, when jam is recovered, and when an environment is changed. The process control operation may not perform a density control with high accuracy unless a photoconductor surface potential is maintained uniformly. Thereby, in a case where the AC voltage setting is performed before the process control operation, and the reference voltage (Vpp_aim) is changed such that the photoconductor surface has a uniform charging amount, and the high accuracy density control may be performed so that a high quality image may be obtained.

When a jam occurs, a toner image which is not transferred to a transfer paper on the photoconductor 1 becomes residual, or transfer remaining, toner. An amount of the transfer remaining toner in excess of permissive amount of the cleaning device for a removal operation is moved to the cleaning device, and the transfer remaining toner which is not removed by the cleaning device is moved to a position where the charging roller and the photoconductor are opposed. At this time, the transfer remaining toner is adhered to a part of the charging roller at which resistance becomes high. Accordingly, a voltage drop at the part of the charging roller with adhesion of the transfer remaining toner become large so that the value double the voltage Vth of the part increases. As a result, a discharge does not occur at the part with adhesion of the transfer remaining toner, and the photoconductor surface may not be uniformly charged. However, in a case where the reference voltage Vpp_aim is set when the jam is recovered, the photoconductor surface may be uniformly charged by the discharge even if the transfer remaining toner is adhered to the charging roller. Therefore, a problem including a case where a deteriorated image such as density unevenness is printed after the jam recovery may be suppressed.

Also, the AC voltage setting may be performed based on a result detected by the environment detection mechanism 105 as a thermohygrometer which may be disposed in the vicinity of the charging roller. In a high temperature and humidity environment, the gap between the charging roller and the photoconductor is narrowed by swelling of the charging roller. Also, the resistance value of the charging roller is decreased by absorbing moisture. Thereby, the discharge amount to the photoconductor 1 is increased, and life of the photoconductor may be shortened in the high temperature and humidity environment although the reference voltage Vpp_aim is capable of obtaining the predetermined discharge amount in the normal temperature and humidity environment. In a low temperature and humidity environment, the resistance value is increased by dryness of the charging roller.

Thereby, the voltage drop at the charging roller becomes large, and the discharge is not started due to not reaching discharge start voltage 2Vth in the low temperature and humidity environment although the reference voltage Vpp_aim is capable of obtaining the predetermined discharge amount in the normal temperature and humidity environment. As a result, photoconductor surface is not uniformly charged. Therefore, setting of the reference voltage Vpp_aim is changed so that the discharge amount to the photoconductor is maintained at an appropriate level, and the life of the photoconductor may be extended in a case where the environment is changed.

Further, a detection mechanism configured to detect a travel distance of the charging roller 3*a* is disposed, and the AC voltage setting may be changed if the travel distance of the charging roller 3*a* exceeds a predetermined value. For the detection mechanism, a detection of the travel distance based on the number of rotations of the charging roller 3*a*, and a number of a passage sheet or a number of rotations of the photoconductor 1 may be employed. In this way, the reference voltage value setting Vpp_aim is performed each time the travel distance of the charging roller 3*a* exceeds the predetermined value so that photoconductor may be charged uniformly even if the resistance of the charger roller 3*a* is increased due to unclean surface caused by usage of the charging roller 3*a* over time.

In addition to above timings, the AC voltage setting is performed when the power source is ON so that the reference voltage value Vpp_aim or the travel distance of the charging roller 3*a* does not require to be stored in a nonvolatile memory, and thereby a cost may be lowered.

Further, the AC voltage setting may be performed manually by a service representative during maintenance. The manual AC voltage setting includes a voltage value setting execution instruction mechanism configured to instruct execution of the reference voltage Vpp_aim setting to the printer 100. The reference voltage Vpp_aim setting is preformed based on execution instruction by the voltage value setting execution instruction mechanism. The voltage value setting execution instruction mechanism may include an operation panel as a display mechanism and the above control mechanism. For example, when a password is input by the service representative into the operation panel of a printer part, the control mechanism recognizes the password, and executes the reference voltage Vpp_aim setting.

An adjustment button may be disposed to the operation panel so that the AC voltage setting may be performed when the button is pressed. In this way, not only the service representative who knows the password, but also a user may perform the reference voltage Vpp_aim setting. In a case where the user performs the reference voltage Vpp_aim setting, an occasion of the reference voltage Vpp_aim setting increases, and thereby the discharge amount to the photoconductor may be maintained at a more appropriate level.

Further, the AC voltage setting may be performed in a case where a door of the apparatus main body is opened and closed. When the image forming unit 2 or the charging device 3 is replaced, a deterioration state of the charging device 3 or the gap between the charging roller 3*a* and the photoconductor 1 changes. Accordingly, the discharge amount to the photoconductor 1 may be increased, or the discharge to the photoconductor 1 may not be performed at the AC voltage value before the replacement. When the door of the apparatus main body is opened and closed, the AC voltage setting is performed because the image forming unit 2 or the charging device 3 is possibly replaced. The control mechanism 101 includes a function as a detection mechanism configured to detect opening and closing of the apparatus door. In particular, the control mechanism 101 sets a door open flag when the apparatus door is opened. When the apparatus door is being closed, the control mechanism 101 checks whether the door open flag is set or not, and the AC voltage setting is performed in a case where the door open flag is set because the image forming unit 2 or the charging device 3 is possibly replaced. The door open flag is deleted after the AC voltage setting is performed. On the other hand, when the door open flag does not exist, the AC voltage setting is not performed because the apparatus door is not opened or closed.

In this way, an optimum AC voltage value may be set to the replaced image forming unit 2 or the charging device 3 by performing the AC voltage setting when the apparatus door is opened and closed, and thereby the discharge amount to the photoconductor 1 may be maintained at the appropriate level. Further, the optimum AC voltage value may be set when the door of the apparatus main body is opened and closed even if the image forming unit 2 or the charging device 3 is not replaced, and thereby the discharge amount to the photoconductor may be maintained at a more appropriate level.

Figure 11:
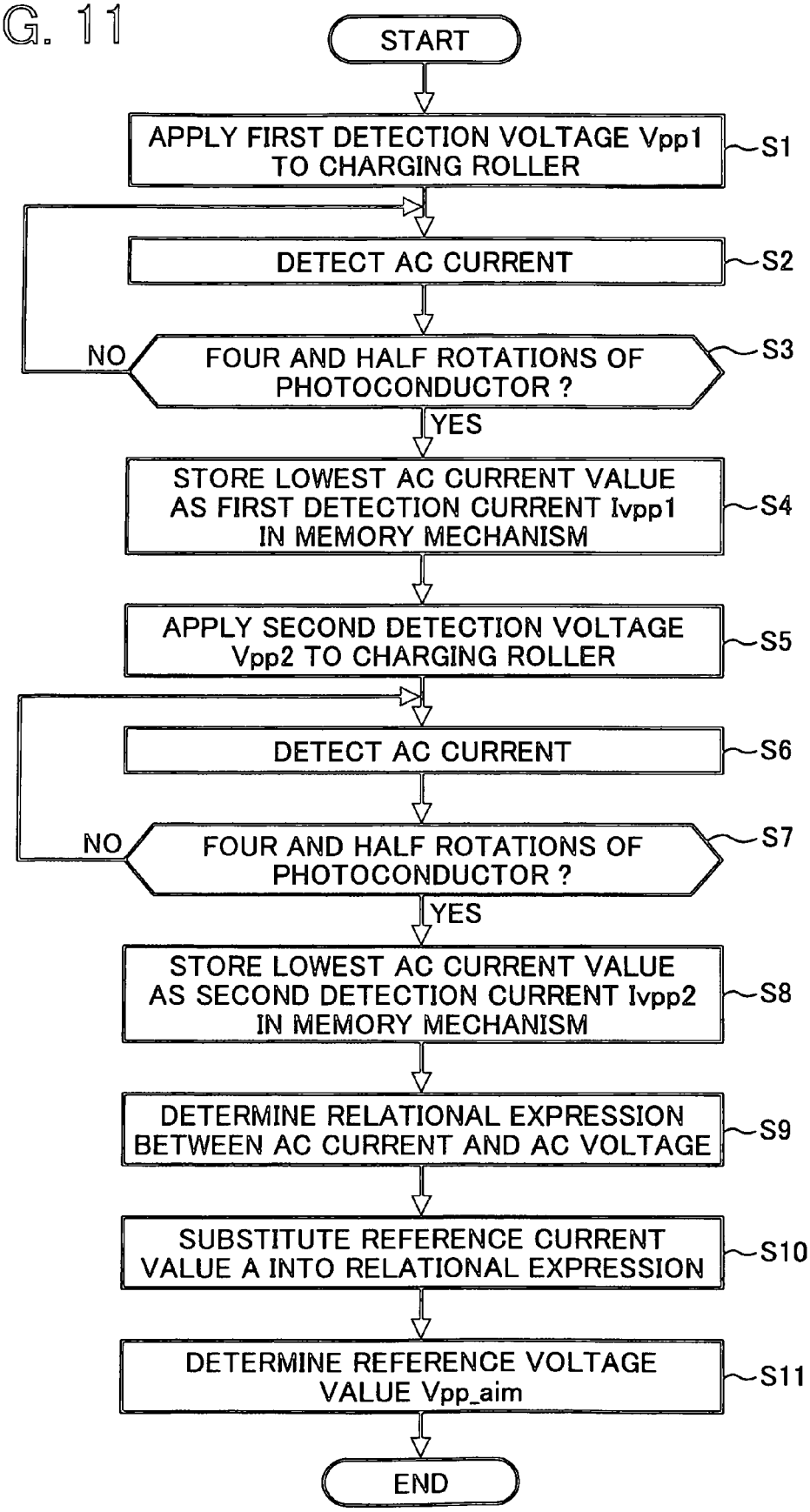
FIG. 11 is a flowchart illustrating an example procedure to control the AC voltage setting.

Referring to FIG. 11, a procedure to control the AC voltage setting is illustrated. When a predetermining timing, for example, when the power source is ON, when the jam is recovered, and when the process control operation is performed as stated above, the AC voltage setting is started. First, the control mechanism 101 causes the photoconductor 1 to rotate, and simultaneously applies the first detection voltage Vpp1 to the charging roller 3*a* (S1). After the first detection voltage Vpp1 is applied to the charging roller 3*a*, the AC current detection mechanism 313 detects the current value flowing into the photoconductor 1, and inputs into the control mechanism 101 (S2). The control mechanism 101 detects a lowest current value from the detected AC current for four and half rotations of the photoconductor, and stores the detected lowest current value as the first detection current Ivpp1 in the memory mechanism 102 (S3 and S4). Next, the second detection voltage Vpp2 is applied to the charging roller 3*a* (S5). Then, the AC current for the four and half rotations of the photoconductor detected by the AC current detection mechanism 313 detects the lowest current value which is then stored as the second detection current Ivpp2 in the memory mechanism 102 (S6 through S8).

In the above explanation, a measurement interval of the AC current is the four and half rotations of the photoconductor. However, the photoconductor 1 is preferably rotated for at least a common multiple of gear engagements of a drive device configured to drive the photoconductor 1. The gap between the charging roller 3*a* and the photoconductor 1 is fluctuated by backlash or eccentricity of the gear. Therefore, the rotation of the photoconductor 1 for the least common multiple is required so that all the gear engagement is detected. In a case of a different drive structure in which the charging roller 3*a* does not rotate with a movement of the photoconductor 1, the photoconductor 1 is preferably rotated for the least common multiple between the gear engagement of a drive device configured to drive the charging roller 3*a* and the gear engagement of the drive device configured to drive the photoconductor 1.

Also, in the above explanation, the lowest current value among current values of the detection current Ivpp detected by the current detection mechanism 313 is used because of following reasons. Both the photoconductor 1 and the charging roller 3*a* are being rotated during the current detection so that the size of the gap constantly fluctuates. Consequently, the discharge amount is decreased, and a current value to be detected is decreased when the gap between the charging roller 3*a* and the photoconductor 1 is large. On the other hand, the discharge amount is increased, and the current value to be detected is increased when the gap between the charging roller 3*a* and the photoconductor 1 is small. Thereby, the lowest current value is treated as the detection current so that the discharge may be performed, and the photoconductor surface may be charged uniformly even if the gap between the charging roller 3*a* and the photoconductor 1 is a largest.

Next, the computation mechanism 103 determines a relational expression between the AC current and the AC voltage (i.e., peak to peak voltage) from the first detection current Ivpp1 and the first detection voltage Vpp1, and the second detection current Ivpp2 and the second detection voltage Vpp2 stored in the memory mechanism (S9). After determination of the relational expression, the reference current value A is substituted into the relational expression (S10), and the computation mechanism 103 determines the reference voltage value Vpp_aim (S11).

The determined reference voltage value Vpp_aim is applied to the charging roller 3*a* so that the predetermined discharge amount capable of uniformly charging the photoconductor surface is obtained. Thereby, deterioration of the photoconductor 1 by the discharge is suppressed, and the photoconductor 1 may be maintained with the predetermined discharge potential.

The reference current value A is set slightly higher than the current value Ivth at which the AC voltage is the double Vth. Consequently, the AC-current value detected by the current detection mechanism 313 is known as an average value of the discharge amount in a longitudinal direction of the charging roller 3*a*. In a case where a concavo/convex part exists in an axial direction of the charging roller 3*a* or the photoconductor 1, the discharge amount is smaller than the average value in an opposing place where a concave part of the charging roller 3*a* and a concave part of the photoconductor 1 are opposed. As a result, in a case where the AC voltage is treated as the current value at which the AC voltage is the double Vth, the discharge may not be performed in the opposing place in which the axial direction concave part of the charging roller and the axial direction concave part of the photoconductor are opposed so that a problem is generated in the opposing place where the photoconductor surface is not uniformly charged to the predetermined potential. However, when the reference current value A is set slightly higher than the current value at which the AC voltage is the double Vth as stated above, a sufficient discharge amount may be obtained, and the photoconductor 1 may be charged uniformly in the axial direction even if a part with the gap between the charging roller 3*a* and the photoconductor 1 in the axial direction is large.

Figure 12:
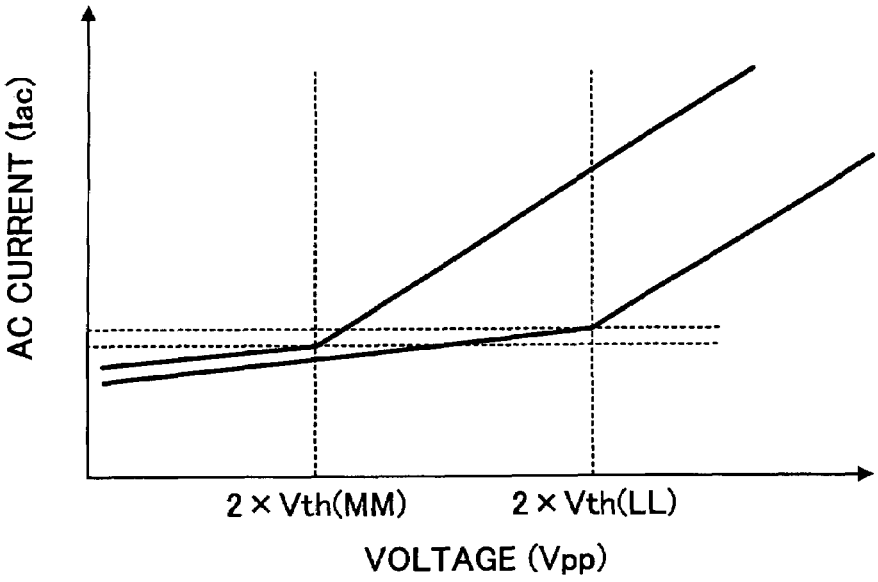
FIG. 12 is a graph for explaining an example relationship between the AC current flown to the photoconductor during an environment change and the AC voltage (i.e., the peak-to-peak voltage) applied to the charging roller.

Next, a transformation embodiment of the AC voltage setting is explained. As stated above, when the environment is changed, the gap between the charging roller and the photoconductor, and the resistance value are changed so that the AC-current Ivth flowing into the photoconductor 1 is also fluctuated during the double Vth. FIG. 12 illustrates a relationship between the AC current flown to the photoconductor and the AC voltage (i.e., the peak-to-peak voltage) applied to the charging roller 3*a* during the environment change. As illustrated in FIG. 12, the AC-current value Ivth in the low temperature and humidity environment (LL) is higher than the AC-current value Ivth in the normal temperature and humidity environment (MM). Thus, in the low temperature and humidity environment, a problem which the discharge amount capable of uniformly charging the photoconductor is not obtained may be generated in the part where the gap between the charging roller 3*a* and the photoconductor 1 is large even if the reference voltage value Vpp_aim determined based on the reference current value A in the normal temperature and humidity environment is applied to the charging roller. Consequently, the alternating-current voltage (i.e., the reference voltage Vpp_aim) setting in the transformation embodiment includes a change mechanism configured to change the reference current value A based on a detection result of the environment change. The alternating-current voltage (i.e., the reference voltage Vpp_aim) is set based on the changed reference current value A. The change mechanism may include the control mechanism 101 and the memory mechanism 102 of FIG. 10. The control mechanism 101 reads and changes the result detected by the environment detection mechanism 105 corresponding the reference current value A from the memory mechanism 102 so that the reference current value A is changed.

Figure 13:
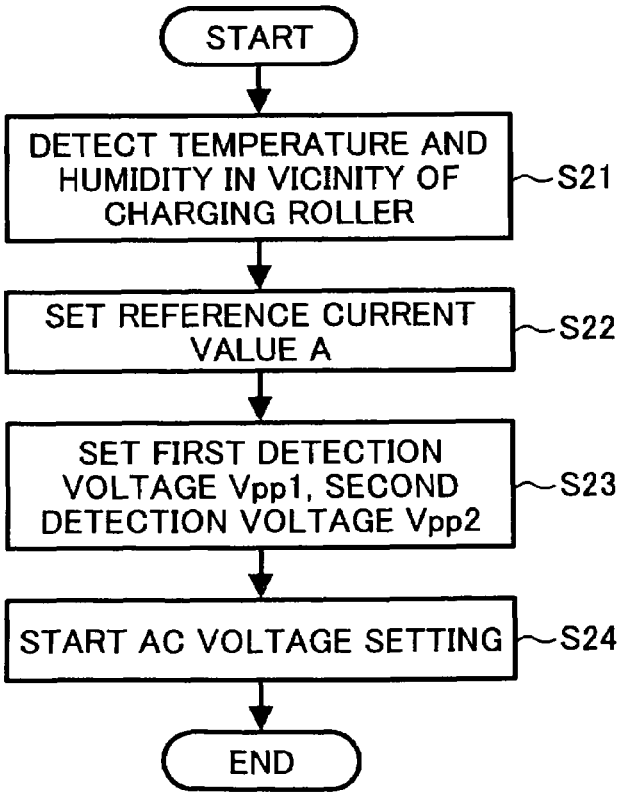
FIG. 13 is a flowchart for explaining an example procedure of setting a reference current value A.

FIG. 13 illustrates the flow of the reference current value A. First, temperature and humidity in the vicinity of the charging roller is detected by the environment detection mechanism 105 as the thermohygrometer disposed in the vicinity of the charging roller 3*a* at the above predetermined timing, for example, when the environment is changed, or before the process control is performed (S21). The reference current value A is set based on absolute humidity (g/cm$^3$) in the vicinity of the charging roller detected by the thermohygrometer (S22). In particular, a reference current table in each environment is stored in the memory mechanism 102 beforehand as indicated in Table 2, and the reference current value A corresponding to the detected absolute humidity is called up. For example, table 2 indicates a relationship between the reference current A (μA) and the absolute humidity (AH) in units of g/cm$^3$.

TABLE 2

| | AH | | | | |
|---|---|---|---|---|---|
| | 0 ≦ AH < 5 | 5 ≦ AH < 8 | 8 ≦ AH < 18 | 18 ≦ AH < 26 | 26 ≦ AH |
| Reference current A (μA) | 530 | 507 | 495 | 490 | 487 |

Next, the first detection voltage Vpp1 and the second detection voltage Vpp2 corresponding to the reference current A are read from the memory mechanism 102, and are set (S23). After the reference current A, the first detection voltage Vpp1, and the second detection voltage Vpp2 are set based on the environment, control which is a same flow as the above FIG. 11 is performed so that the AC voltage (i.e., the reference voltage Vpp_aim) is set (S24).

As the reference current value A is changed in response to the environment change, the alternating current voltage value (i.e., the reference voltage Vpp_aim) corresponding to the environment in which the reference voltage is set may be accurately determined. Therefore, the determined reference voltage value Vpp_aim is applied to the charging roller so that the predetermined discharge amount for uniformly charging the photoconductor is obtained in a case of the low temperature and humidity environment (LL).

In a case where the resistance value of the charging roller 3*a* is changed, not only the relationship (e.g., the inclination) between the AC current and the AC voltage with at least the value double the voltage Vth, but also Ivth are changed. In a case where an identical reference alternating current value A is used, the discharge amount capable of uniformly charging the photoconductor may not be obtained, or the discharge amount becomes more than necessary so that the photoconductor may be deteriorated early because each resistance value of the charging roller 3*a* is different. Therefore, in the embodiment, the reference alternating current A may be changed in every charging roller. In particular, an ID chip is disposed to a frame body of the image forming unit 2, and the reference alternating current A corresponding to the resistance value of the charging roller 3*a* inside the image forming unit is stored in the ID chip.

The apparatus main body includes a communication mechanism configured to communicate with the above ID chip, and for example, communicates with the ID chip when a door of the apparatus main body is opened and closed. In a case where a preset flag is not stored in the ID chip because of a newly replaced imaging forming unit 2, the reference alternating current value A stored in the ID chip is read, and is changed to the reference alternating current value stored in the memory mechanism 102. Thereby, the reference alternating current value A stored in the memory mechanism 102 may be treated as the reference alternating current value corresponded to the resistance value of the charging roller 3*a* inside the replaced image forming unit. Thus, the photoconductor may be charged uniformly while deterioration of the photoconductor due to an excess discharge amount may be suppressed. After the reference alternating current value stored in the memory mechanism 102 is changed to the reference alternating current value A stored in the ID chip, the preset flag is stored in the ID chip. Accordingly, communication with the ID chip is performed when the door of the apparatus main body is opened and closed, and the image forming unit 2 is identified whether the replaced unit or a unit which is remained inside the apparatus without replacement by checking the ID chip whether the preset flag is stored. Therefore, communication with the ID chip is completed when the preset flag is stored in the ID chip.

Further, information including image forming condition such as exposure amount, charging amount, and development bias may be stored in the ID chip. An optimum image forming condition such as an optimum exposure amount, a charging amount, and a development bias may vary depending on variations in producing a product such as the photoconductor inside the image forming unit 2 or the development roller. The optimum image forming condition is stored in the ID chip, and then the image forming condition is changed in a case where the reference alternating current value A is changed. Therefore, an image is formed under the image forming condition corresponded to the image forming unit 2 so that a satisfactory image may be obtained.

The ID chip is disposed to the image forming unit 2 in the above explanation. However, the ID chip may be disposed only to the charging device 3, and the reference alternating-current value A may be stored in the ID chip disposed to the charging device 3.

According to the above embodiments, the alternating-current voltage applying to the charging mechanism is set based on the first alternating current Ivpp1 flown to a body to be charged when the first alternating-current voltage Vpp1 is applied to the charging mechanism, and the second alternating-current Ivpp2 flown to the body to be charged when the second alternating-current voltage Vpp2 is applied to the charging mechanism.

Figure 14:
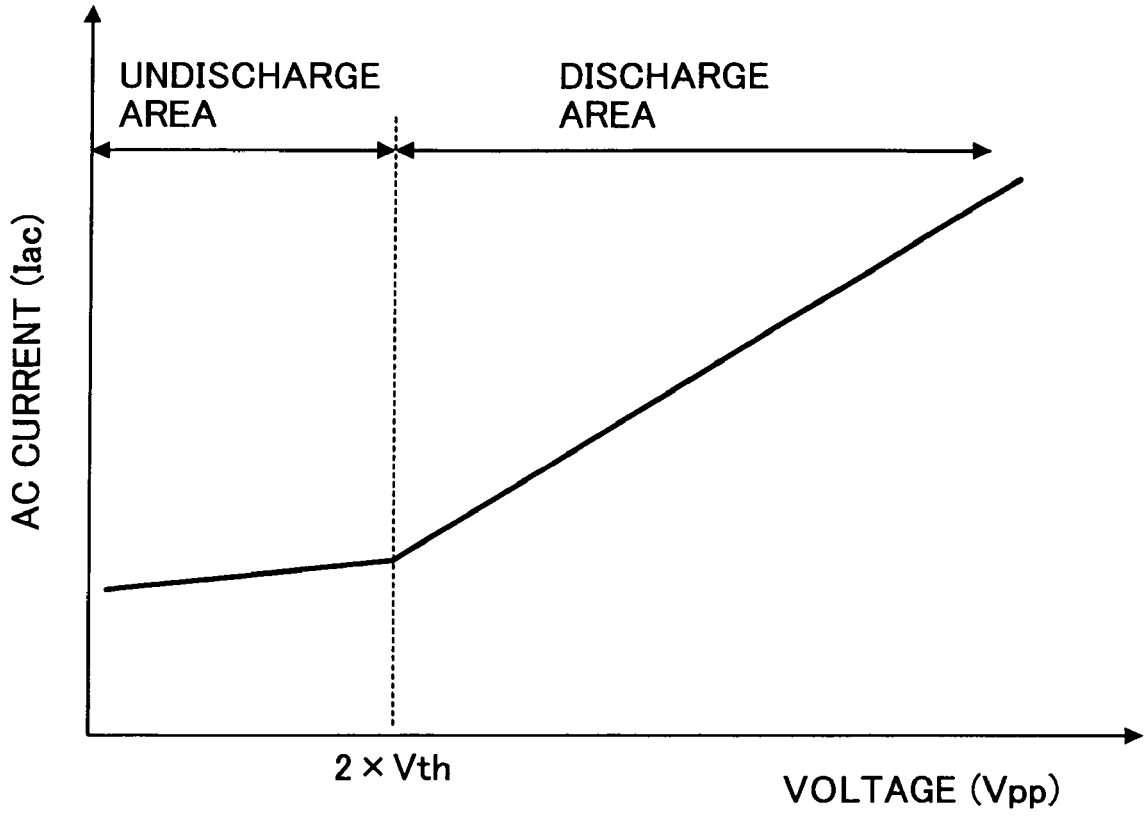
FIG. 14 is a graph for explaining an example relationship between the AC current flowing to the photoconductor and the AC voltage (i.e., the peak-to-peak voltage) applying to the charging roller.

Referring to FIG. 14, a relationship between the alternating-current voltage and an alternating current flown to the body to be charge when the alternating-current voltage is applied to the charging mechanism is illustrated in the graph. According to FIG. 14, the alternating-current voltage which is at least the value double the discharge-start voltage Vth, and the alternating current flown to the body to be charged are in a proportional relationship. The relationship between the alternating-current voltage which is at least double the discharge-start voltage Vth and the alternating current flown to the body to be charged may be seen from the first alternating-current Ivpp1 flown to the body to be charged when the first alternating-current voltage Vpp1 is applied to the charging mechanism, and the second alternating-current Ivpp2 flown to the body to be charged when the second alternating-current voltage Vpp2 is applied to the charging mechanism. According to the relationship, the alternating-current voltage value capable of obtaining the predetermined discharge amount may be set. In this way, the relationship between the alternating-current voltage and the alternating current is grasped during the alternating-current voltage value setting. Then the alternating-current voltage value corresponded to the gap between the charging mechanism and the body to be charged, or the resistance value of the charging mechanism during the alternating-current voltage value setting may be set because the alternating-current voltage value is set from the grasped relationship. Consequently, the predetermined discharge amount may be obtained when the alternating-current voltage which is set is applied to the charging mechanism, and the body to be charged may be uniformly charged while deterioration of the body to be charged by the discharge may be suppressed. Further, the alternating-current voltage value capable of obtaining the predetermined discharge amount may be set only by detecting the alternating-current value twice. Therefore, the alternating-current voltage value setting for obtaining the predetermined discharge amount does not require detection of the alternating-current value a number of times like a conventional manner so that the alternating-current voltage value may be set in a short period of time.

Therefore, according to the voltage control method of the embodiment, the alternating-current voltage applying to the charging roller of the charging device as the charging mechanism is set from the first detection-current Ivpp1 flown to the photoconductor as the body to be charged when the first detection-voltage Vpp1 is applied to the charging roller, and the second detection-current Ivpp2 flown to the photoconductor when the second detection-voltage Vpp2 is applied to the charging roller. In this way, the alternating-current voltage value capable of obtaining the predetermined discharge amount may be set, and deterioration of the photoconductor by the discharge may be suppressed. Further, the alternating-current voltage value capable of obtaining the predetermined discharge amount may be set only by detecting the alternating-current value twice. Therefore, the alternating-current voltage value setting for obtaining the predetermined discharge amount does not require detection of the alternating-current value a number of times like a conventional manner so that the alternating-current voltage value capable of obtaining the predetermined discharge amount may be set in a short period of time.

Also, according to the voltage control method of the embodiment, the environment detection mechanism configured to detect temperature and/or humidity in the vicinity of the charging roller is disposed, and the alternating-current voltage value setting is performed when the environment change is detected by the environment detection mechanism. In a high temperature and humidity environment, the gap between the charging roller and the photoconductor is narrowed by swelling of the charging roller. Also, the resistance value of the charging roller is decreased by absorbing moisture. Thereby, the discharge amount is increased, and life of the photoconductor may be shortened in the high temperature and humidity environment although the reference voltage (Vpp_aim) is capable of obtaining the predetermined discharge amount in the normal temperature and humidity environment. In a low temperature and humidity environment, on the other hand, the resistance value is increased by dryness of the charging roller. Thereby, the discharge is not performed, or the photoconductor surface is not charged uniformly in the low temperature and humidity environment although the reference voltage (Vpp_aim) is capable of obtaining the predetermined discharge amount in the normal temperature and humidity environment. Therefore, setting of the alternating-current voltage is changed so that the discharge amount to the photoconductor is maintained at the appropriate level in a case where the environment is changed.

In the high temperature and humidity environment, with the gap between the charging roller and the photoconductor is narrowed, and the resistance value of the gap is decreased, the resistance value of the charging roller is decreased so that the current is more easily flown to the photoconductor compared to the normal temperature and humidity environment. Thus, an increase of the alternating current flowing to the photoconductor becomes larger compared to the normal temperature and humidity environment with respect to the increase of the alternating-current voltage. On the other hand, in the low temperature and humidity environment, with the resistance value is increased by dryness of the charging roller, the gap between the photoconductor and the charging roller is expanded, and the resistance value of the gap is increased so that the current is more difficult to be flown to the photoconductor. Consequently, the increase of alternating current flowing to the photoconductor becomes smaller compared to the normal temperature and humidity environment with respect to the increase of the alternating-current voltage. Vth is also fluctuated as explained in TABLE 1 due to the environment change. Therefore, the relationship between the alternating-current voltage applying to the charging roller and the alternating current flowing to the photoconductor may be different depending on the environment change.

According to the voltage control method of the embodiment, the relational expression between the alternating-current voltage which is at least double the discharge-start voltage Vth and alternating current flown to the photoconductor is determined from the first detection voltage Vpp1, the first detection-current value Ivpp1, the second detection-voltage Vpp2, and the second detection-current value Ivpp2. The reference alternating-current value A which is set beforehand being capable of uniformly charging the photoconductor is substituted into the determined relational expression so that the alternating-current voltage value (reference voltage Vpp_aim) applying to the charging roller is set. In the embodiment, the relationship between the alternating current and the alternating-current voltage is determined based on the alternating current which is detected when the alternating-current voltage is applied to the charging roller during the alternating-current voltage setting. Thus, the relationship between detected alternating current and the alternating-current voltage is the relationship between the alternating current and the alternating voltage in environment during the alternating-current voltage setting. Consequently, the alternating-current voltage value (reference voltage Vpp_aim) determined from the relationship between the alternating current and the alternating voltage, and the reference alternating-current value A is a value corresponded to the environment during the alternating-current voltage setting. Therefore, when the alternating-current voltage is applied to the charging roller, the predetermined discharge amount may be obtained, and the photoconductor surface is uniformly charged while deterioration of the photoconductor surface is suppressed.

As the environment such as temperature and humidity is changed, the AC current value (Ivth) flowing to the photoconductor surface is fluctuated by external factors such as fluctuations of the resistance value of the charging roller, fluctuations of the resistance value between the gap, and harness when the discharge is stated. As a result, even if the alternating-current voltage determined based on the reference-current value A which is set beforehand is applied to the charging roller 3*a*, the discharge is not performed to the photoconductor, or the discharge amount becomes more than necessary, and the photoconductor may be deteriorated early. However, in the embodiment, the reference alternating-current value A is fluctuated with respect to the environment change so that the alternating-current voltage value capable of obtaining the predetermined discharge amount may be set in a case of the environment change.

Further, according to the charging device of the embodiment, the alternating-current voltage applying to the charging roller as the charging member is set from the first detection-current Ivpp1 flown to the photoconductor as the body to be charged when the first detection-voltage Vpp1 is applied to the charging roller, and the second detection-current Ivpp2 flown to the photoconductor when the second detection-voltage Vpp2 is applied to the charging roller. In this way, the alternating-current voltage value (reference voltage Vpp_aim) capable of obtaining the predetermined discharge amount may be set, and deterioration of the photoconductor by the discharge may be suppressed. Further, the alternating-current voltage value (reference voltage Vpp_aim) capable of obtaining the predetermined discharge amount may be set only by detecting the alternating-current value twice. Therefore, the setting of the alternating-current voltage value capable of obtaining the predetermined discharge amount does not require detection of the alternating-current value a number of times like a conventional manner so that the alternating-current voltage value (reference voltage Vpp_aim) may be set in a short period of time.

Also, according to the charging device of the embodiment, the alternating-current voltage value (reference voltage Vpp_aim) applying to the charging roller is determined from the first detection-voltage Vpp1, the first detection-current value Ivpp1, the second alternating-current voltage Vpp2, the second alternating-current value Ivpp2, and the reference alternating-current value A which is set beforehand being capable of uniformly charging the photoconductor. In particular, the relationship between the alternating-current voltage and the alternating current during the alternating-current voltage setting is grasped from the detection current value and the detection voltage detected during the alternating-current voltage setting. In this way, the relationship between the alternating-current voltage and the alternating current in the environment during the alternating-current voltage setting is grasped. The alternating-current voltage value capable of obtaining the reference alternating-current value A is determined from the grasped relationship between the alternating-current voltage and the alternating current, and thereby the alternating-current voltage value capable of obtaining the predetermined discharge amount in the environment during the alternating-current voltage setting may be accurately determined.

Also, according to the charging device of the embodiment, the environment detection mechanism configured to detect temperature and/or humidity in the vicinity of the charging roller is disposed, and the alternating-current voltage value (reference voltage Vpp_aim) is set when the environment change is detected by the environment detection mechanism. In the high temperature and humidity environment, the gap between the charging roller and the photoconductor is narrowed by swelling of the charging roller. Also, the resistance value of the charging roller is decreased by absorbing moisture. Thereby, the discharge amount is increased more than the predetermined value, and life of the photoconductor may be shortened in the high temperature and humidity environment although the alternating-current voltage value is capable of obtaining the predetermined discharge amount in the normal temperature and humidity environment. In the low temperature and humidity environment, on the other hand, the resistance value is increased by dryness of the charging roller. Thereby, the voltage value becomes below the value 2vth at which the discharge is started, and the discharge is not performed to the photoconductor surface so that the photoconductor surface may not be uniformly charged in the low temperature and humidity environment although the alternating-current voltage value is capable of obtaining the predetermined discharge amount in the normal temperature and humidity environment. Therefore, the alternating-current voltage setting is performed in a case of the environment change, and the alternating-current voltage value is changed to a value capable of obtaining the predetermined discharge amount in the changed environment so that the discharge amount to the photoconductor is remained at the predetermined amount without being affected by the environment change, and life of the photoconductor may be extended.

According to the charging device of the embodiment, the reference alternating-current value A is changed based on the detection result by the environment detection mechanism. In a case where the current value (Ivth) at which the discharge to the photoconductor is started is changed by the environment change such as temperature and humidity, the reference alternating-current value A is changed in response to the current value change, and thereby the alternating-current voltage value capable obtaining the predetermined discharge amount may be accurately determined.

In addition, according to the charging device of the embodiment, the ID chip is disposed to the charging device, and the reference alternating-current value A corresponded to the resistance value of the charging roller of the charging device is stored in the ID chip. The alternating-current voltage value (reference voltage Vpp_aim) applying to the charging roller is set by using the reference alternating-current value A stored in the ID chip so that deterioration of the photoconductor caused by excess amount of the discharge for uniformly charging the photoconductor may be suppressed.

According to the image forming apparatus of the embodiment, the satisfactory image without the density unevenness may be obtained by using the discharge device stated above.

Also, according to the image forming apparatus of the embodiment, the process control operation as the image density adjustment mechanism configured to adjust the image density is included, and after the reference voltage value Vpp_aim as the alternating-current voltage is set by a voltage value setting mechanism configured to set the alternating-current voltage value applying to the charging member, the image density is adjusted by the process control operation. The process control operation may not perform density control with high accuracy unless photoconductor surface potential is maintained uniformly. Thereby, when the alternating-current voltage value capable of uniformly charging the photoconductor surface is set by alternating-current voltage setting before the process control operation, the high accuracy density control may be performed so that the high quality image may be obtained.

According to the image forming apparatus of the embodiment, the reference voltage value Vpp_aim is set by the voltage value setting mechanism when the jam is recovered. When the jam occurs, the toner image which is not transferred to the transfer paper on the photoconductor becomes transfer remaining toner. Thereby, amount of the transfer remaining toner in excess of permissive amount of the cleaning device for removal operation is moved to the cleaning device, and the transfer remaining toner which is not removed by the cleaning device is moved to the position where the charging roller and the photoconductor are opposed. At this time, the transfer remaining toner is adhered to the charging roller, and the resistance value of the charging roller is increased so that the discharge is not performed to the photoconductor surface by the alternating-current voltage prior to the jam, and the photoconductor surface may not be uniformly charged. However, the alternating-current voltage is set when the jam is recovered so that the alternating-current voltage value is changed to the reference voltage value Vpp_aim capable of obtaining the predetermined discharge amount by the charging roller with high resistance value caused by adhesion of the transfer remaining toner. Therefore, the problem including a case where the deteriorated image such as the density unevenness is printed after the jam recovery may be suppressed.

According to the image forming apparatus of the embodiment, the reference voltage value Vpp_aim is set by the voltage value setting mechanism each time the travel distance of the charging roller reaches the predetermined travel distance. Thereby, the discharge amount to the. photoconductor may be maintained at the appropriate level even if the resistance value is changed due to unclean surface of the charger roller caused by usage of the charging roller over time.

According to the image forming apparatus of the embodiment, the reference voltage value Vpp_aim is set by the voltage value setting mechanism when main power source of the apparatus is turned ON. In this way, the reference voltage value prior to turning OFF the main power source is not required to be stored. Consequently, the reference voltage value prior to turning OFF the main power source is not required to be stored in the nonvolatile memory in which a memory is not erased even if the main power is turned OFF. In addition, the reference voltage corresponded to a deterioration state of the charging roller is set when the main power source is turned ON so that the travel distance of the charging roller is not required to be stored in the nonvolatile memory even if the power source is tuned OFF. Thereby, amount of memory to be stored in the nonvolatile memory may be reduced, and cost may be lowered.

According to the image forming apparatus of the embodiment, the voltage value setting execution instruction mechanism configured to instruct execution of the voltage value setting mechanism is included, and the voltage value setting mechanism is executed based on the execution instruction given by the voltage value setting execution instruction mechanism. Thereby, the reference voltage value may be set by the voltage value setting mechanism in a case such as maintenance where the reference voltage value is intended to be set at a value capable of charging the photoconductor satisfactorily.

Further, in a case where the charging device is replaced without the reference voltage value Vpp_aim setting, the discharge is generated with more than the predetermined amount so that the photoconductor may be deteriorated, or the discharge is not performed so that the photoconductor may not be uniformly charged. According to the image forming apparatus of the embodiment, when the door of the apparatus main body is opened and closed, the charging device is possibly replaced. Therefore, the reference voltage value Vpp_aim is set by the voltage value setting mechanism when the door of the apparatus main body is opened and closed so that the predetermined discharge amount to the photoconductor may be maintained even if the charging device is replaced.

According to the image forming apparatus of the embodiment, the ID chip which stores the reference alternating-current value A corresponded to the resistance value of the charging roller inside the process cartridge is disposed to the process cartridge having the photoconductor and at least the charging device. The reference voltage value Vpp_aim applying to the charging roller is set from the reference alternating-current value A stored in the ID chip. Thereby, the reference voltage value Vpp_aim applying to the charging roller corresponded to the resistance value of the charging roller may be set, and the predetermined discharge amount to the photoconductor may be maintained.

According to the process cartridge of the embodiment, for example, replacement of the charging device may be easily performed.

According to the process cartridge of the embodiment, the ID chip which stores the reference alternating-current value A corresponded to the resistance value of the charging roller inside the process cartridge is disposed. Therefore, the reference voltage value Vpp_aim is set by using the reference alternating-current value A stored in the ID chip when the process cartridge is replaced, and thereby the reference voltage value Vpp_aim applying to the charging roller corresponded to the resistance value of the charging roller may be set, and the predetermined discharge amount to the photoconductor may be maintained.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JP 2005-136102 filed on May 9, 2005 and No. JP 2005-263019 filed on Sep. 9, 2005 in the Japan Patent Office, the entire contents of which are incorporated by reference herein.

What is claimed as new and desired to be secured by Letters Patent of the United States is:

1. An image forming apparatus, comprising:

a charge carrier configured to carry a charge;

an AC voltage calculator configured to calculate a value of an alternating-current voltage of an application voltage based on first and second alternating-current voltages, first and second alternating currents, and a predefined reference alternating current capable of evenly charging a surface of the charge carrier;

a charging device configured to charge the surface of the charge carrier, the charging device comprising:

a charge-applying device arranged parallel to and facing the charge carrier, a power controller configured to apply to the charge carrier the application voltage including a direct-current voltage and the alternating-current voltage superimposed onto the direct-current voltage, an alternating-current detector configured to detect an alternating current flowing through the charge carrier when the charge-applying device applies the application voltage to the charge carrier, and a voltage value controller configured to determine the value of the alternating-current voltage of the application voltage based on at least two alternating currents detected by the alternating-current detector; and an instructing mechanism configured to generate an instruction, wherein the voltage value controller is configured to determine the alternating-current voltage value of the application voltage in accordance with the instruction generated by the instructing mechanism, the at least two alternating currents include the first and second alternating currents detected when the power controller applies the first and second alternating-current voltages, respectively, of the application voltage to the charge-applying device, and the first and second alternating-current voltages are different from each other and each have a value at least double a discharge-start voltage that initiates an electrical discharge from the charge-applying device to the charge carrier.

2. The image forming apparatus of claim 1, wherein the charge carrier is further configured to carry an electrostatic image.

3. The image forming apparatus of claim 1, further comprising:

an environment detector arranged at a position close to the charge-applying device and configured to detect at least one of ambient temperature and humidity; and a reference AC adjuster configured to change the predefined reference alternating current in accordance with a detection result detected by the environment detector.

4. The image forming apparatus of claim 3, wherein the voltage value controller is configured to determine the alternating-current voltage value of the application voltage upon a detection of an environmental change through the environment detector.

5. The image forming apparatus of claim 1, wherein the charging device further includes an identification memory chip configured to store the predefined reference alternating current value.

6. The image forming apparatus of claim 1, further comprising:

an image density adjuster configured to adjust a density of an image after a determination of the alternating-current voltage value of the application voltage by the voltage value controller.

7. The image forming apparatus of claim 1, wherein the voltage value controller is configured to determine the alternating-current voltage value of the application voltage after a recovery from a jam of a recording sheet.

8. The image forming apparatus of claim 1, wherein the voltage value controller is configured to determine the alternating-current voltage value of the application voltage when a main power switch of the apparatus is turned on.

9. The image forming apparatus of claim 1, further comprising:

a door arranged at a window accessible to the charging device and configured to be opened and closed when the charging device is replaced, wherein the voltage value controller is configured to determine the alternating-current voltage value of the application voltage when the door is opened and closed.

10. The image forming apparatus of claim 5, wherein the charge carrier and the charging device are assembled together in a process cartridge that is exchangeable as a whole, and the identification memory chip storing the predefined reference alternating current is mounted to the process cartridge, and the AC voltage calculator is configured to calculate the alternating-current voltage of the application voltage based on the predefined reference alternating current value stored in the identification memory chip.

11. An image forming apparatus, comprising:

a charge carrier configured to carry a charge;

a charging device configured to charge a surface of the charge carrier, the charging device comprising:

a charge-applying device arranged parallel to and facing the charge carrier, a power controller configured to apply to the charge carrier an application voltage including a direct-current voltage and an alternating-current voltage superimposed onto the direct-current voltage, an alternating-current detector configured to detect an alternating current flowing through the charge carrier when the charge-applying device applies the application voltage to the charge carrier, and a voltage value controller configured to determine a value of the alternating-current voltage of the application voltage based on at least two alternating currents detected by the alternating-current detector; and an instructing mechanism configured to generate an instruction, wherein the voltage value controller is configured to determine the alternating-current voltage value of the application voltage in accordance with the instruction generated by the instructing mechanism, the charge-applying device is configured to rotate with the charge carrier, the image forming apparatus includes a run detector configured to detect a travel distance of a surface of the charge-applying device by a rotation thereof, and the voltage value controller is configured to determine the alternating-current voltage value of the application voltage when the travel distance of the surface of the charge-applying device reaches a predetermined value.

12. A charging device, comprising:

a charge carrier configured to carry a charge;

a charging device configured to charge a surface of the charge carrier, the charging device comprising:

a charge-applying device arranged parallel to and facing the charge carrier, a power controller configured to apply to the charge carrier an application voltage including a direct-current voltage and an alternating-current voltage superimposed onto the direct-current voltage, an alternating-current detector configured to detect an alternating current flowing through the charge carrier when the charge-applying device applies the application voltage to the charge carrier, and a voltage value controller configured to determine an alternating-current voltage value of the application voltage based on at least two alternating currents detected by the alternating-current detector, wherein the at least two alternating currents include first and second alternating currents detected when the power controller applies first and second alternating-current voltages, respectively, of the application voltage to the charge-applying device; and an AC voltage calculator configured to calculate the alternating-current voltage of the application voltage based on the first and second alternating-current voltages, the first and second alternating currents, and a predefined reference alternating current capable of evenly charging the surface of the charge carrier, wherein the first and second alternating-current voltages are different from each other and each has a value at least double a discharge-start voltage that initiates an electrical discharge from the charge-applying device to the charge carrier when a direct-current voltage is singularly applied as the application voltage to the charge-applying device.

13. The charging device of claim 12, further comprising:

an environment detector arranged at a position close to the charge-applying device and configured to detect at least one of ambient temperature and humidity; and a reference AC adjuster configured to change the predefined reference alternating current in accordance with a detection result detected by the environment detector.

14. The charging device of claim 13, wherein the voltage value controller is configured to determine the alternating-current voltage value of the application voltage upon a detection of an environmental change through the environment detector.

15. The charging device of claim 12, further comprising:

an identification memory chip configured to store the predefined reference alternating current value.

* * * * *